United States Patent [19]

Muth

[11] Patent Number: 4,733,511

[45] Date of Patent: Mar. 29, 1988

[54] GRAVITY CLOSING FIRE-RATED CEILING ACCESS DOOR

[75] Inventor: James C. Muth, Milwaukee, Wis.

[73] Assignee: Milcor Incorporated, Lima, Ohio

[21] Appl. No.: 843,498

[22] Filed: Mar. 25, 1986

[51] Int. Cl.[4] ..... E06B 5/00; E05F 1/02

[52] U.S. Cl. ..... 52/204; 49/5; 49/213

[58] Field of Search ..... 52/204, 19; 49/213, 49/214, 226, 376, 5, 2

[56] References Cited

U.S. PATENT DOCUMENTS

| | | | |
|---|---|---|---|
| Re. 28,346 | 2/1975 | Kouth et al. | 49/214 |
| 1,820,127 | 8/1931 | Elkington | 49/213 |
| 3,359,695 | 12/1967 | Gazerro | 52/204 |
| 3,910,628 | 10/1975 | Nantau | 49/214 |

FOREIGN PATENT DOCUMENTS

| | | | |
|---|---|---|---|
| 685868 | 1/1953 | United Kingdom | 49/214 |
| 717261 | 2/1980 | U.S.S.R. | 52/19 |

*Primary Examiner*—J. Karl Bell

*Attorney, Agent, or Firm*—Marshall, O'Toole, Gerstein, Murray & Bicknell

[57] ABSTRACT

This disclosure relates to an access door assembly for a ceiling. The assembly includes a frame adapted to be attached to supports of the ceiling and mounted in a generally horizontal position, and a door which fits within the frame. Tracks on the frame receive rollers on the door for mounting the door for movement between open and closed position. The tracks are sloped to gravity actuate the door to the closed position.

16 Claims, 8 Drawing Figures

GRAVITY CLOSING FIRE-RATED CEILING ACCESS DOOR

FIELD AND BACKGROUND OF THE INVENTION

This invention relates broadly to a building construction, and more specifically to an automatically closing access door assembly for fire resistive floor/ceiling assembly of a building.

It is customary in modern buildings to make the floors of reinforced concrete or other material and to install the "utilities" in and below the floor. The utilities include, for example, plumbing, air ducts, communication, computer and electrical wiring. A ceiling or membrane is normally mounted below the utilities in order to separate the utilities from the space of the floor below.

In the past, "access doors" have also been provided in the ceiling which enable technicians to reach the utilities from the floor below, in order to service or modify them. Such an access door is described, for example, in U.S. Pat. No. 4,098,024 dated July 4, 1978. In the past, the primary requirement of the door design has been merely that it have an acceptable appearance and provide access to the space above.

It would be advantageous for such a door to also have fire or heat protection capability. Where the ceiling is made of a fire retardant material such as gypsum, it would be desirable to have the door capable of meeting at least the rating of the ceiling in order to maintain the fire rating of the floor/ceiling assembly. Such a door would be required to pass a fire test similar to the test required for a fire resistive floor/ceiling assembly. Fire protection capability is, of course, desirable in order to keep the fire from spreading to other locations and to protect the utilities from damage in the event of a fire in the floor space below.

Copending U.S. patent application Ser. No. 799,140, filed Nov. 18, 1985 discloses an access door which meets the fire ratings. The access door disclosed in U.S. Ser. No. 799,140 is designed to swing downwardly on a hinge to the open position, and in some instances a downwardly hanging door may interfere with the activities of the service technicians. The door also includes a return spring arrangement for closing the door.

It is therefore a general object of this invention to provide an improved ceiling access door assembly which has both an acceptable appearance and fire protection capability, and does not have a hinged door or a return spring.

BRIEF SUMMARY OF THE INVENTION

An access door assembly in accordance with this invention comprises a mounting frame which forms a door opening and is adapted to be attached to supports of a ceiling in a generally horizontal position. A door is mounted on the frame and is movable between an open position and a closed position. The frame includes tracks and the door has rollers which move in the tracks, and the tracks are sloped to cause the door automatically to move by force of gravity toward the closed position. Thus the door avoids the need for a closing spring assembly and a lock for holding the door closed.

BRIEF DESCRIPTION OF THE DRAWINGS

The invention will be better understood from the following detailed description taken in conjunction with the accompanying figures of the drawings, wherein.

DETAILED DESCRIPTION OF THE DRAWINGS

Figure 1:
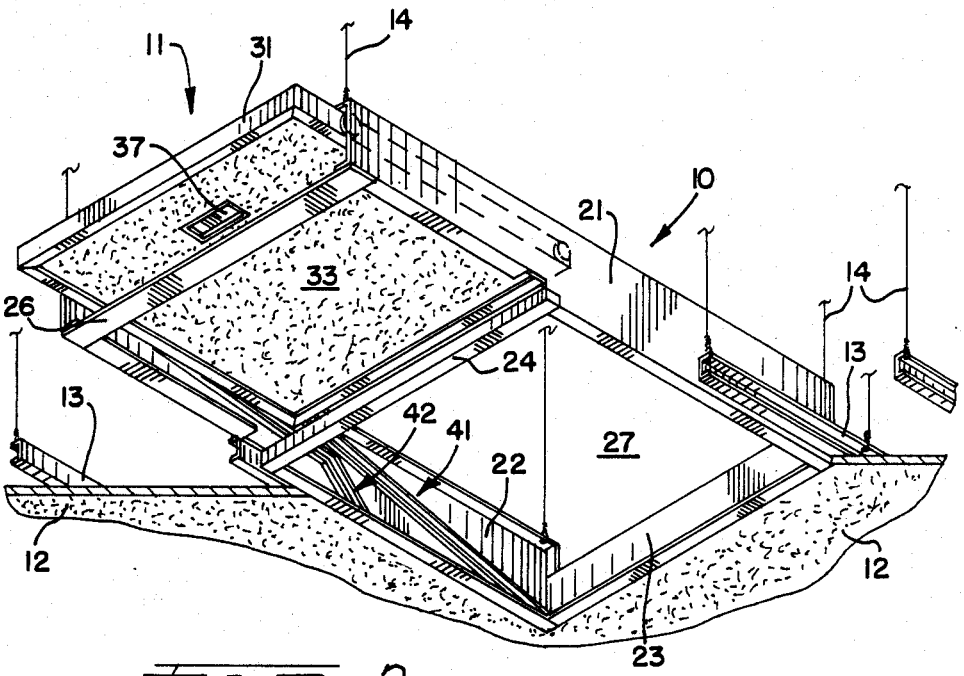
FIG. 1 is a perspective view of an access door assembly in accordance with the invention, showing the door in the open position.

The invention relates to a door mounting frame 10 and a door 11, the frame and door assembly being adapted to be mounted in a ceiling as shown in FIG. 1. The ceiling is formed by ceiling panels 12 secured to the undersides of channels 13, and the channels 13 in turn are supported by wire hangers 14 attached to the underside of a ceiling/floor (not shown) above the assembly. The channels 13 and the wires 14 are, in this example, made of metal and the ceiling panels 12 are preferably made of a fire-resistant material such as gypsum drywall. The foregoing arrangement of the ceiling panels, etc. may be conventional. The utilities (not shown) are mounted in the space between the ceiling/floor and the panels 12.

With reference specifically to FIGS. 1 to 4, the mounting frame 10 is formed by a plurality of metal members which are secured together, as by spot welding, to form a rectangular frame. The members include two elongated track sides 21 and 22 which are channel-shaped and parallel. Across one end of the track sides is secured a support side 23 which extends transversely across the ends of the sides 21 and 22. Substantially midway along the length of the sides 21 and 22 is a mid-support brace 24, and across the other end of the sides 21 and 22 is a end support brace 26. The two braces 24 and 26 extend transversely of the track sides 21 and 22 and are secured to the undersides of the track sides.

Figure 2:
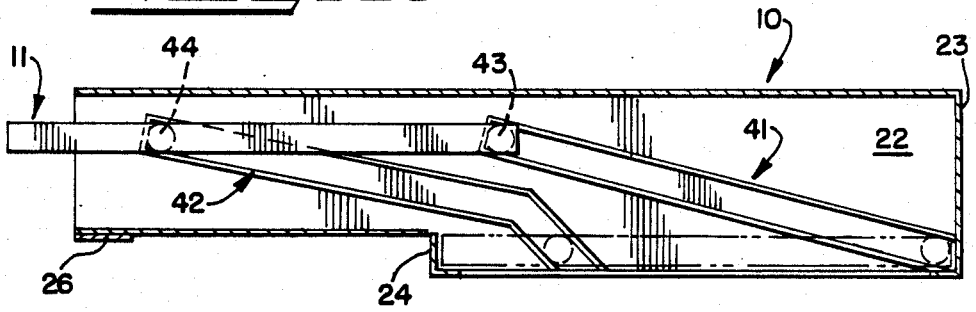
FIG. 2 is a sectional view of the assembly showing the door in the open position.
Figure 3:
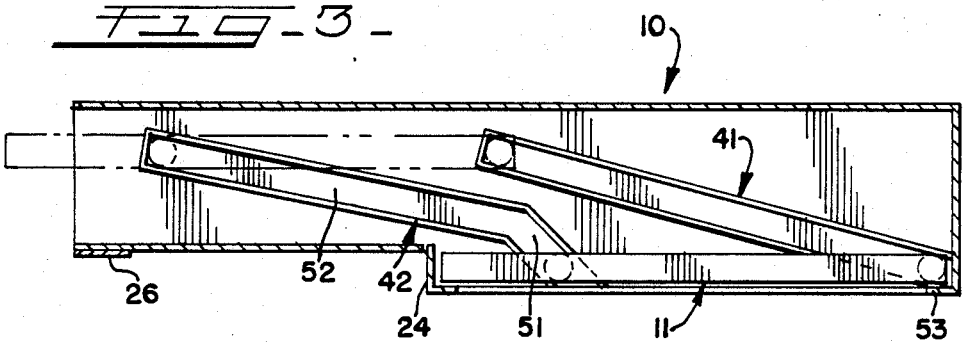
FIG. 3 is a sectional view similar to FIG. 2 but showing the door in the closed position.
Figure 4:
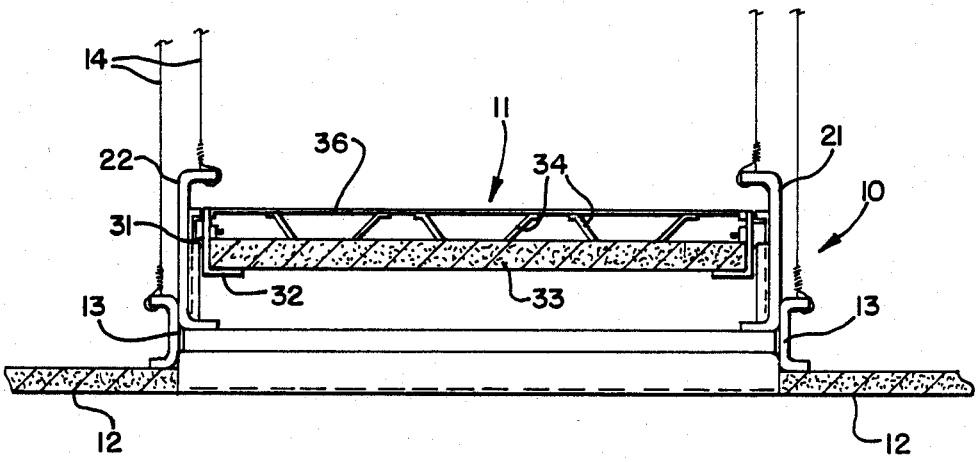
FIG. 4 is a sectional view taken on the line 4—4 of FIG. 2.

As is best shown in FIGS. 1 to 3, the portions of the track sides 21 and 22 to the left of the mid support brace 24 are offset upwardly relative to the right-hand portions, and the amount of the offset is slightly greater than the vertical thickness of the ceiling panels 12. The support side 23, the mid-support brace 24, and the right-hand portions of the two track sides 21 and 22 form a substantially square door opening, the lower edges of these form members being substantially flush with the lower sides of the ceiling panels. These four members thus form an outline or periphery of the door opening 27. The left-hand portions of the track sides 21 and 22 extend above and are hidden by the adjacent ceiling panels. The track sides 21 and 22 extend parallel to and are secured to a pair of the channels 13 (see FIG. 1) in order to support the door assembly in the ceiling. In addition, wire hangers 14 may be attached between the track sides 21 and 22 and the ceiling/floor.

The door panel 11 is mounted on the two track sides 21 and 22, and it is movable between a closed position (FIG. 3) and an open position (FIGS. 1 and 2). In the closed position the door panel completely closes or covers the door opening 27, whereas in the open position a technician may reach through the opening 27.

The door panel 11 includes a frame 31 formed by an angle member that is bent to the shape of a square or rectangle. The lower side 32 (FIG. 4) of the angle extends horizontally at the bottom surface of the panel, and the side 32 supports the outer periphery of a fire-retardant board 33 that may be made of the same material and have the same texture as the ceiling panels 12. Alternatively, the board 33 may be a ceramic fiber board as described in U.S. application Ser. No. 799,140, and the disclosure of U.S. application Ser. No. 799,140 is incorporated herein by reference. Extending across the upper side of the board 33 are channel-shaped stiffeners 34 and a metal top plate 36, the parts being secured together as by screws. A metal handle or grip 37 (FIG. 1) is attached to the underside of the board 33 to assist a technician in opening the door.

Figure 5:
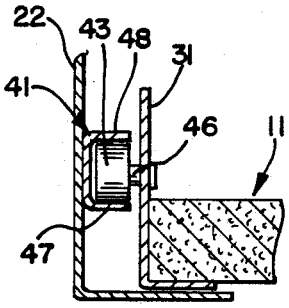
FIG. 5 is an enlarged fragmentary sectional view of a track and roller of the assembly.

The door panel 11 is mounted by rollers on the track sides 21 and 22 such that the panel is gravity actuated to the closed position regardless of the position of the panel. With particular reference to FIGS. 1 to 3, forward and rearward tracks 41 and 42 are secured to the interior surface of each track side 21 and 22. In the preferred form of the invention, each of the tracks has a channel or U-shaped cross section, the web of the channel being secured as by spot welding to the associated track side. Two forward rollers 43 and two rearward rollers 44 are rotatably mounted on each side of the door panel 11, each roller 43 being on a bolt or bearing shaft 46 (see FIG. 5) which is fastened to the vertical sides of the angle 31. The forward rollers 43 are positioned between the flanges of the forward tracks 41 whereas the rearward rollers 44 are similarly mounted in the rearward tracks 42. The rollers 43 and 44, of course, ride on the lower flanges 47 of the tracks and the upper flanges 48 prevent the rollers (and the door panel 11) from moving upwardly.

The forward tracks 41 and rollers 43 support the forward (to the right as seen in FIGS. 1 to 3) portion of the panel 11, and, of course, the rearward tracks 42 and rollers 44 support the rearward portion of the panel. The two forward tracks 41 extend to the lower right-hand corners of the track sides 21 and 22, and they slope upwardly and rearwardly from this corner. The rearward tracks 42 have their forwardmost ends adjacent the lower edges of the track sides 21 and 22 and they slope upwardly and rearwardly. Each of the tracks 42 has a forward portion 51 which slopes upwardly at a relatively steep angle and a rearward portion that slopes upwardly at a lower angle. The rollers 43 and 44 are located on the door panel at positions where the door is in the fully closed position (see FIG. 3) when the rollers are at the lower and forward ends of the tracks. To open the door panel, a technician pushes the panel upwardly and rearwardly and the rollers ride along the tracks as the panels move to the open position shown in FIG. 2 where the panel is substantially clear of the opening 27. As shown in FIGS. 2 and 3, the lower ends of the channels are at the same level and the rearward ends are at another level, so that the door panel is essentially horizontal at both the open and the closed positions. The rearward end of the door panel tilts upwardly during the opening and closing movements because of the steeper slope of the track portions 51, so that the rearward end of the panel clears the mid-support brace 24.

It will be apparent therefore that the slopes of the channels will cause the door panel to move automatically to the closed position. When in the closed position, the panel rests on and is supported by the lower flanges 53 of the track sides 21-22, the end support side 23 and the mid-support brace 24 and thereby tightly closes the door opening 27; the panel is not supported by the rollers and the tracks when in the closed position.

The upper flanges 48 of the tracks retain the rollers in the tracks and prevent the door panel from being moved upwardly in the event of an explosive force in the space below the ceiling. The tracks have a relatively low slope so that the upper flanges 48 are able to prevent such upward movement.

Figure 6:
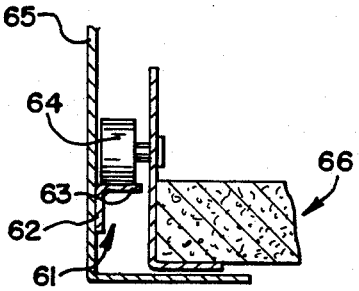
FIGS. 6, 7 and 8 are views similar to FIG. 5 but show alternative constructions.

In the form of the invention shown in FIG. 6, four angle-shaped half-tracks 61 are provided instead of the channel-shaped tracks. Each track 61 includes a vertical arm 62 secured to the adjacent track side 65 and a horizontal arm 63 on which rests a roller 64. The construction is otherwise the same as is shown and described in connection with FIGS. 1 to 5. The FIG. 6 construction is less expensive but the tracks do not prevent upward movement of the door panel 66.

Figure 7:
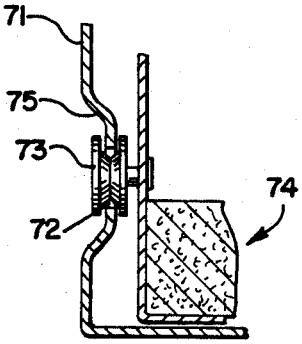

In FIG. 7, tracks are formed in each track side 71 by forming elongated slots 72 in the sides. Slotted wheels 73 are rotatably mounted on the sides of the door panel 74 and roll along the slots 72. The sides 71 may be deformed as indicated at 75, so that the wheels 73 are recessed from the outer surfaces of the sides.

Figure 8:
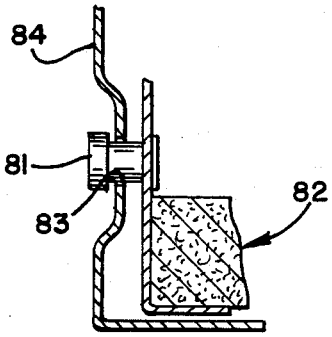

The structure shown in FIG. 8 is generally the same as that in FIG. 7. Bushings 81 are mounted on the sides of a door panel 82 and move in slots 83 of the track sides 84. The bushings 81 may slide or roll in the slots.

The tracks 62 and the slots 72 and 83 preferably have the same general configuration as the tracks 41 and 42 of FIGS. 1 to 5. The constructions of the parts not shown in FIGS. 6 to 8 may be the same as the corresponding parts shown in FIGS. 1 to 5.

It will be apparent from the foregoing that an improved access door assembly has been provided. When the door is closed as shown in FIG. 3, it is substantially flush with the ceiling panels 12 and presents a pleasing aesthetic appearance. The close fitting arrangement of the sides of the door with the flanges 53 of the door frame 10 retards the flow of heat and flames upwardly from the space below to the cavity above the ceiling. The provision of the gravity actuated closing arrangement also is important in that it returns the door panel 11 to the closed position after it has been opened by a serviceman. It is important for fire protection purposes that the door be closed under normal circumstances, and the closing arrangement thereby ensures that the door will not be left accidentally in the open position after servicing.

What is claimed is:

1. An access door assembly for a ceiling, comprising a door frame adapted to be mounted in a ceiling, said frame forming a door opening, a moveable door panel positioned within said frame and having forward and rearward ends, a plurality of tracks on said frame, rollers on said forward end and on said rearward end of said door panel and engaging said tracks for mounting said door panel for movement between an open position and a closed position relative to said frame, said tracks being sloped throughout their lengths and thereby always gravity actuating said door panel to roll on said rollers to said closed positions where said door panel closes said opening.

2. An assembly according to claim 1, wherein said frame includes a substantially horizontally extending flange around said door opening, said tracks and said rollers causing said door panel to move to and be supported by said flange when said panel is in said closed position.

3. An assembly according to claim 1, wherein said tracks are channel-shaped members, and said rollers extend within the channels of said members.

4. An assembly according to claim 1, wherein said tracks are slots in said frame, and said rollers extend into said slots.

5. An assembly according to claim 1 wherein said tracks are angle-shaped members, and said rollers rest on top of said members.

6. An assembly according to claim 1, wherein said door panel when in said open position being above and to one side of said door opening, said rollers on said door panel engaging said slopes of said tracks when said door panel is in said open position and said door panel being gravity actuated toward said closed position regardless of the position of said rollers on said tracks.

7. An assembly according to claim 1, wherein said door panel when out of said closed position rests on said rollers engaging said tracks.

8. An access door assembly for a ceiling, the ceiling including a plurality of relatively thin ceiling panels suspended below a ceiling/floor, a space being formed between said ceiling panels and said ceiling/floor, and an access opening being formed in said ceiling panels, said assembly comprising a door frame adapted to be supported by said ceiling/floor, said frame comprising track sides including forward portions adapted to extend into said access opening and rearward portions adapted to extend above adjacent ceiling panels, a plurality of tracks on said track sides, a door panel positioned between said track sides, rollers on the forward and rearward ends of said door panel and engaging said tracks for mounting said door panel on said track sides for movement between a closed position and an open position, said door panel closing said access opening when in said closed position and being in said space above said ceiling panels when in said open position, and said tracks being sloped throughout the entire distance between said open position and said closed position to thereby always gravity actuate said door panel to said closed position.

9. An assembly according to claim 8, wherein said plurality of tracks comprise of a pair of forward tracks on said forward portion of said track sides and a pair of rearward tracks on said track sides extending from said forward portion of said track sides to said rearward portion of said track sides, and said rollers comprise of a pair of forward rollers on the forward portion of said door panel which engage said forward tracks and a pair of rearward rollers on the rearward portion of said door panel which engage said rearward tracks.

10. An assembly according to claim 9 wherein the forwardmost portion of the rearward tracks is sloped upwardly and rearwardly at a relatively steep angle and the rearward portion of said rearward tracks is sloped upwardly and rearwardly at a less steep angle and wherein said forward tracks are sloped upwardly and rearwardly at a constant angle.

11. An assembly according to claim 8 wherein said door panel when in said closed position is relatively flush to said ceiling panels.

12. A ceiling assembly comprising a plurality of relatively thin ceiling panels adapted to be suspended below a ceiling/floor, a space being formed between said ceiling panels and said ceiling/floor, an access opening being formed in said ceiling panels, a door frame adapted to be supported by said ceiling/floor, said frame comprising track sides including forward portions extending into said access opening and rearward portions extending above adjacent ceiling panels, a plurality of tracks on said track sides, a door panel positioned between said track sides, rollers on said door panel at opposite ends of said door panel and engaging said tracks for mounting said door panel on said track sides for movement between a closed position and an open position, said door panel closing said access opening when in said closed position and being in said space above said ceiling panels when in said open position, and said tracks being sloped throughout their entire length between said open position and said closed position to thereby gravity actuate said door panel to said closed position.

13. An assembly according to claim 12, wherein said plurality of tracks comprise of a pair of forward tracks on said forward position of said track sides and a pair of rearward tracks on said tracks sides extending from said forward portion of said track sides to said rearward portion of said track sides, and said rollers comprise of a pair of forward rollers on the forward portion of said door panel which engage said forward tracks and a pair of rearward rollers on the rearward portion of said door panel which engage said rearward tracks.

14. An assembly according to claim 13 wherein the forwardmost portion of the rearward tracks is sloped upwardly and rearwardly at a relatively steep angle and the rearward portion of said rearward tracks is sloped upwardly and rearwardly at a less steep angle and wherein said forward tracks are sloped upwardly and rearwardly at a constant angle.

15. An assembly according to claim 12 wherein said door panel when in said closed position is relatively flush to said ceiling panels.

16. An access door assembly for a ceiling, the ceiling including a plurality of relatively thin ceiling panels suspended below a ceiling/floor, a space thereby being formed between said ceiling panels and said ceiling/floor, and an access opening being formed in said ceiling panels, said assembly comprising a door frame adapted to be supported by said ceiling/floor, said frame comprising track sides on two opposing sides of the opening, each of said track sides including forward portions adapted to extend into said access opening and rearward portions adapted to extend above adjacent ceiling panels, two tracks on each of said track sides, a door panel positioned between said track sides, rollers at opposite ends on said door panel and engaging said tracks for mounting said door panel on said track sides for movement between a closed position and an opened position, said door panel closing said access opening when in said closed position and being in said space above said ceiling panels when in said open position, said two tracks on each of said track sides being sloped from said rearward portions downwardly and to said forward portions to thereby gravity actuate said door panel to said closed position when said door panel is out of said closed position.

* * * * *